US011873591B2

(12) United States Patent
Oie et al.

(10) Patent No.: US 11,873,591 B2
(45) Date of Patent: Jan. 16, 2024

(54) EMBROIDERY UNIT ATTACHING AND DETACHING DEVICE AND SEWING MACHINE

(71) Applicant: JANOME Corporation, Hachioji (JP)

(72) Inventors: Takeshi Oie, Hachioji (JP); Takuya Sawada, Hachioji (JP)

(73) Assignee: JANOME Corporation, Hachioji (JP)

( * ) Notice: Subject to any disclaimer, the term of this patent is extended or adjusted under 35 U.S.C. 154(b) by 0 days.

(21) Appl. No.: 17/880,663

(22) Filed: Aug. 4, 2022

(65) Prior Publication Data

US 2023/0062799 A1 Mar. 2, 2023

(30) Foreign Application Priority Data

Aug. 26, 2021 (JP) ..... 2021-138356

(51) Int. Cl.
*D05B 3/24* (2006.01)
*D05C 9/04* (2006.01)

(52) U.S. Cl.
CPC ..... *D05B 3/243* (2013.01); *D05C 9/04* (2013.01)

(58) Field of Classification Search
CPC . D05B 3/243; D05B 3/00; D05B 3/04; D05B 3/24; D05B 39/00; D05B 35/00; D05B 21/00; D05C 9/04; D05C 9/00
See application file for complete search history.

(56) References Cited

U.S. PATENT DOCUMENTS 4,565,142 A * 1/1986 McGann ..... D05B 77/00 112/260
7,293,514 B2 * 11/2007 Fukao ..... D05B 73/10 112/260
7,568,441 B2 * 8/2009 Fukao ..... D05B 27/24 112/168
2009/0013913 A1 * 1/2009 Nonobe ..... D05B 3/243 112/260

FOREIGN PATENT DOCUMENTS

JP H05-42276 A 2/1993

* cited by examiner

*Primary Examiner* — Ismael Izaguirre
(74) *Attorney, Agent, or Firm* — Yokoi & Co., U.S.A.; Toshiyuki Yokoi

(57) ABSTRACT

Provided with an embroidery unit attaching and detaching device capable of preventing an embroidery unit from falling from a sewing machine and capable of preventing the damage of a portion connecting the embroidery unit and the sewing machine even when the moment load of twisting the embroidery unit with respect to the sewing machine is applied. An embroidery unit attaching and detaching device includes: a lock mechanism configured to operate in association with a motion of an embroidery unit in an attaching direction to restrict the motion of the embroidery unit in a detaching direction with respect to a sewing machine; and support mechanisms for restricting a relative motion of the sewing machine and the embroidery unit in a vertical direction where recessed portions and protruded portions are engaged with each other.

5 Claims, 5 Drawing Sheets

EMBROIDERY UNIT ATTACHING AND DETACHING DEVICE AND SEWING MACHINE

CROSS-REFERENCES TO RELATED APPLICATIONS

This patent specification is based on Japanese patent application, No. 2021-138356 filed on Aug. 26, 2021 in the Japan Patent Office, the entire contents of which are incorporated by reference herein.

BACKGROUND OF THE INVENTION

1. Field of the Invention

The present invention relates to an embroidery unit attaching and detaching device for enabling an attachment and a detachment between a sewing machine having an embroidery function and an embroidery unit.

2. Description of the Related Art

A sewing machine capable of performing an automatic embroidery sewing by attaching an embroidery unit for controlling the drive of an embroidery frame in an X-axis direction and a Y-axis direction is known. In the above described kind of sewing machine, a sewing object such as a fabric is fixed to the embroidery frame and the embroidery frame is controlled to move in the X-axis direction and the Y-axis direction in association with a sewing operation of the sewing machine. Thus, an embroidery can be formed on the sewing object. When the embroidery sewing is not performed, the embroidery unit can be detached from the sewing machine and various attaching/detaching devices for achieving the detaching operation are proposed.

As for the above described embroidery unit attaching/detaching device, Patent document 1 shows an attaching/detaching device where a lock for fall prevention is actuated when a bottom portion of the sewing machine is released from a workbench. In the sewing machine shown in Patent document 1, the embroidery unit is detached when lifting up the sewing machine as a proper operation method. However, even when the user lifts up the sewing machine in a state that the embroidery unit is attached, the embroidery unit can be prevented from falling from the sewing machine by the above described lock by using the attaching/detaching device.

[Patent document 1] Japanese Unexamined Patent Application Publication No. H5-42276

BRIEF SUMMARY OF THE INVENTION

On the other hand, motors are provided on the embroidery unit for controlling to drive the embroidery frame in the X-axis direction and the Y-axis direction. In addition, the motors are electrically connected with the sewing machine by connectors and the like provided on the embroidery unit.

When the attaching/detaching device of Patent document 1 is used, although the embroidery unit can be prevented from falling from the sewing machine by the above described lock, the lock can support the embroidery unit only by points or lines. Thus, enough resistance against the moment load cannot be expected when the embroidery unit is twisted with respect to the sewing machine, for example. Therefore, when the above described moment load is applied to the embroidery unit, the load (force) is also applied to the connector. Thus, there is a risk of causing the damage on the connector.

The present invention provides an embroidery unit attaching and detaching device capable of preventing the embroidery unit from falling from the sewing machine even when the sewing machine is lifted up in a state that the embroidery unit is attached and capable of preventing the damage of the portion (e.g. connector) connecting the embroidery unit and the sewing machine even when the moment load of twisting the embroidery unit with respect to the sewing machine is applied.

The present invention is an embroidery unit attaching and detaching device enabling to detachably attach an embroidery unit to a sewing machine, including: a lock mechanism configured to operate in association with a motion of the embroidery unit in an attaching direction to restrict the motion of the embroidery unit in a detaching direction with respect to the sewing machine; a recessed portion provided on one of the sewing machine and the embroidery unit; and a protruded portion provided on the other of the sewing machine and the embroidery unit, wherein the recessed portion and the protruded portion are configured to engage with each other to form a support mechanism for restricting a relative motion of the sewing machine and the embroidery unit in a vertical direction, and the support mechanism is provided on three or more portions so that the three or more portions are arranged in a single plane.

In the above described embroidery unit attaching and detaching device, it is preferred that a protruded portion projecting mechanism configured to house the protruded portion inside the protruded portion projecting mechanism is further provided, and the protruded portion is configured to project toward the recessed portion when the embroidery unit is moved in the attaching direction.

In the above described embroidery unit attaching and detaching device, it is preferred that the lock mechanism includes: a lock releasing lever configured to move in the detaching direction with respect to the embroidery unit; a sewing machine side lock portion provided on the sewing machine; and an embroidery unit side lock portion provided on the embroidery unit, and the embroidery unit side lock portion is configured to engage with the sewing machine side lock portion and operate in association with a motion of the lock releasing lever in the detaching direction to release an engagement from the sewing machine side lock portion.

In addition, the present invention is the sewing machine including any one of the above described embroidery unit attaching and detaching devices and the embroidery unit.

By using the embroidery unit attaching and detaching device of the present invention, the embroidery unit can be prevented from falling by the support mechanism and the lock mechanism even when the sewing machine is lifted up in a state that the embroidery unit is attached. In addition, since the support mechanism is provided on three or more portions so that the three or more portions are arranged in a single plane, the embroidery unit is firmly fixed to the sewing machine in a roll direction, a pitch direction and a yaw direction. Accordingly, even when only the sewing machine is lifted up in a state that the embroidery unit is attached, the damage of the portion (e.g. connector) connecting the embroidery unit and the sewing machine can be prevented.

DETAILED DESCRIPTION OF THE INVENTION

Figure 1:
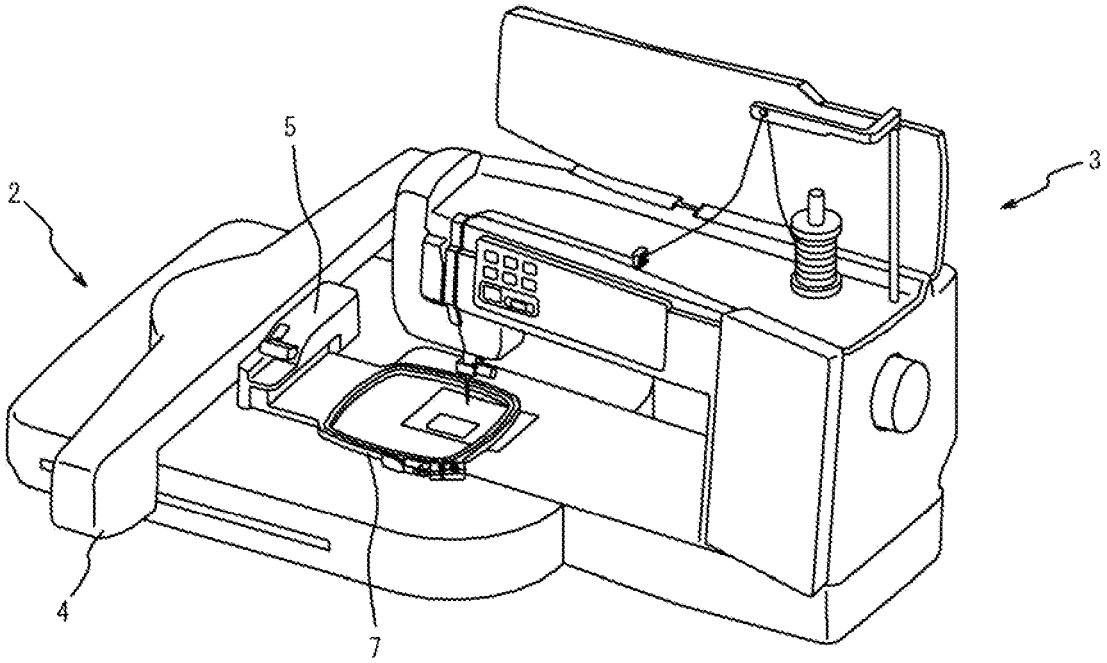
FIG. 1 is a perspective view of an embroidery unit and a sewing machine having an embroidery unit attaching and detaching device of an embodiment of the present invention.
Figure 1:
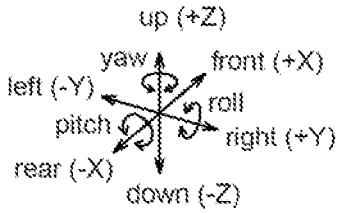

Hereafter, an embodiment of an embroidery unit attaching and detaching device of the present invention and an embodiment of an embroidery unit and a sewing machine provided with the embroidery unit attaching and detaching device will be explained with reference to the drawings. In the specification of the present invention, the directions of right, left, front, rear, up and down are the directions viewed from the user using the sewing machine 3 in a state that a sewing machine 3 of the present embodiment is placed on a workbench. In addition, the X-axis direction, the Y-axis direction and the Z-axis direction in the following explanation is a front/rear direction, a left/right direction and an up/down direction (vertical direction) respectively as shown in the drawings. Furthermore, the roll direction, the pitch direction and the yaw direction are the direction surrounding around the Y-axis, the direction surrounding around the X-axis and the direction surrounding around the Z-axis respectively as shown in the drawings.

Figure 2:
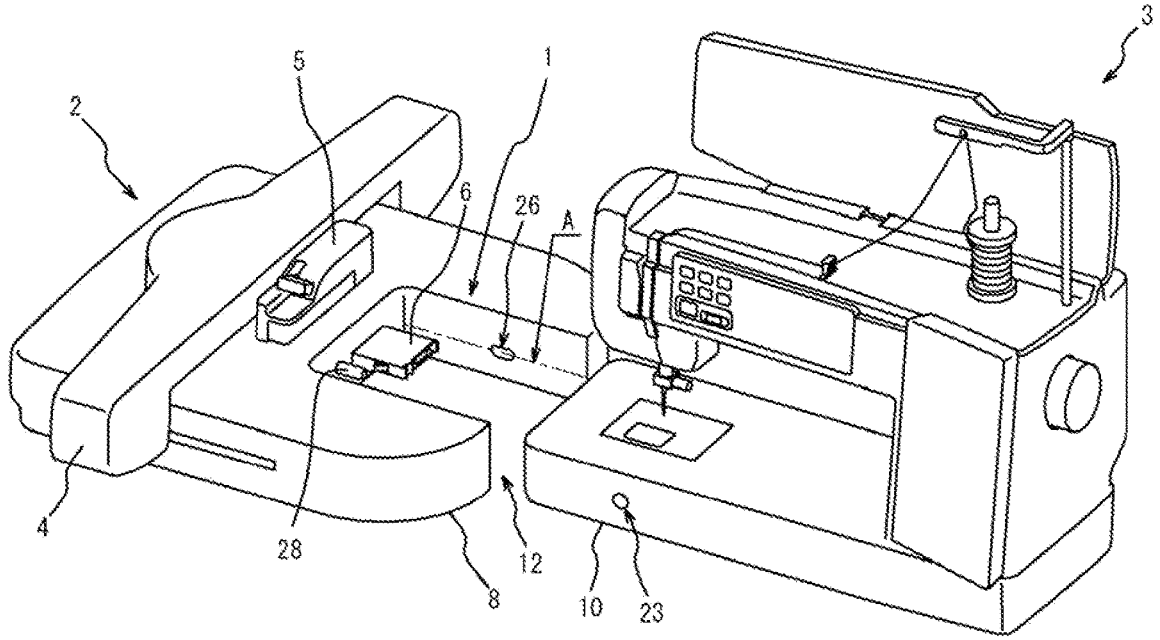
FIG. 2 is a perspective view showing a state that the embroidery unit is detached from the sewing machine shown in FIG. 1.
Figure 2:
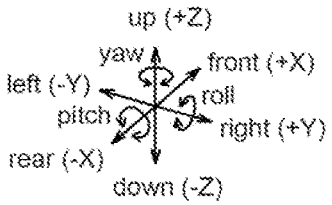

First, an outline of an embroidery unit 2 and a sewing machine 3 provided with an embroidery unit attaching and detaching device 1 of the present embodiment will be explained with reference to FIG. 1 and FIG. 2. The embroidery unit 2 can be attached to and detached from the sewing machine 3 by the embroidery unit attaching and detaching device 1. Here, FIG. 1 is a drawing showing a state that the embroidery unit 2 is attached to the sewing machine 3 and FIG. 2 is a drawing showing a state that the embroidery unit 2 is detached from the sewing machine 3. As described above, the embroidery unit 2 is moved from the left to the right with respect to the sewing machine 3 when the embroidery unit 2 is attached to the sewing machine 3, and the embroidery unit 2 is moved from the right to the left with respect to the sewing machine 3 when the embroidery unit 2 is detached from the sewing machine 3 in the present embodiment. Note that "attaching direction" is the direction from the left to the right and "detaching direction" is the direction from the right to the left when the motion of attaching/detaching the embroidery unit 2 to/from the sewing machine 3 is explained by using "attaching direction" and "detaching direction."

The embroidery unit 2 of the present embodiment can move a carriage 5 in the X-axis direction and the Y-axis direction via a Y-X driving arm 4 by using a not-illustrated motor incorporated in the embroidery unit 2. The motor is electrically connected with the sewing machine 3 by a connector unit 6 shown in FIG. 2. As shown in FIG. 1, when an embroidery operation is performed in a state that the embroidery unit 2 is attached to the sewing machine 3, a sewing object such as a fabric is fixed by an embroidery frame 7 and the embroidery frame 7 is attached to the carriage 5, the embroidery frame 7 is controlled to move in the X-axis direction and the Y-axis direction in association with (interlocking with) a sewing operation of the sewing machine 3. Thus, the embroidery is formed on the sewing object.

Figure 3:
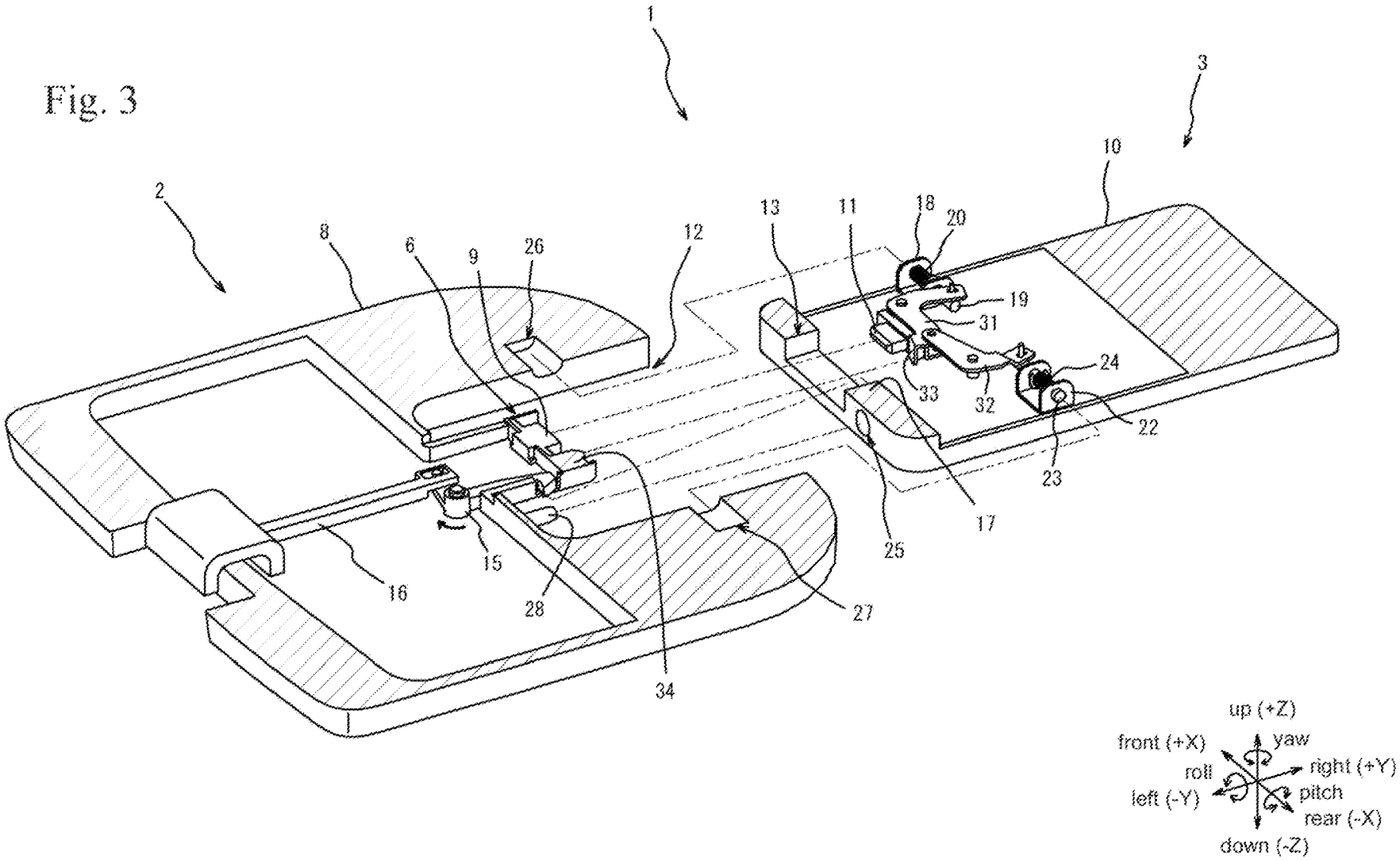
FIG. 3 is a partial cross-sectional view of the embroidery unit attaching and detaching device shown in FIG. 1.
Figure 4:
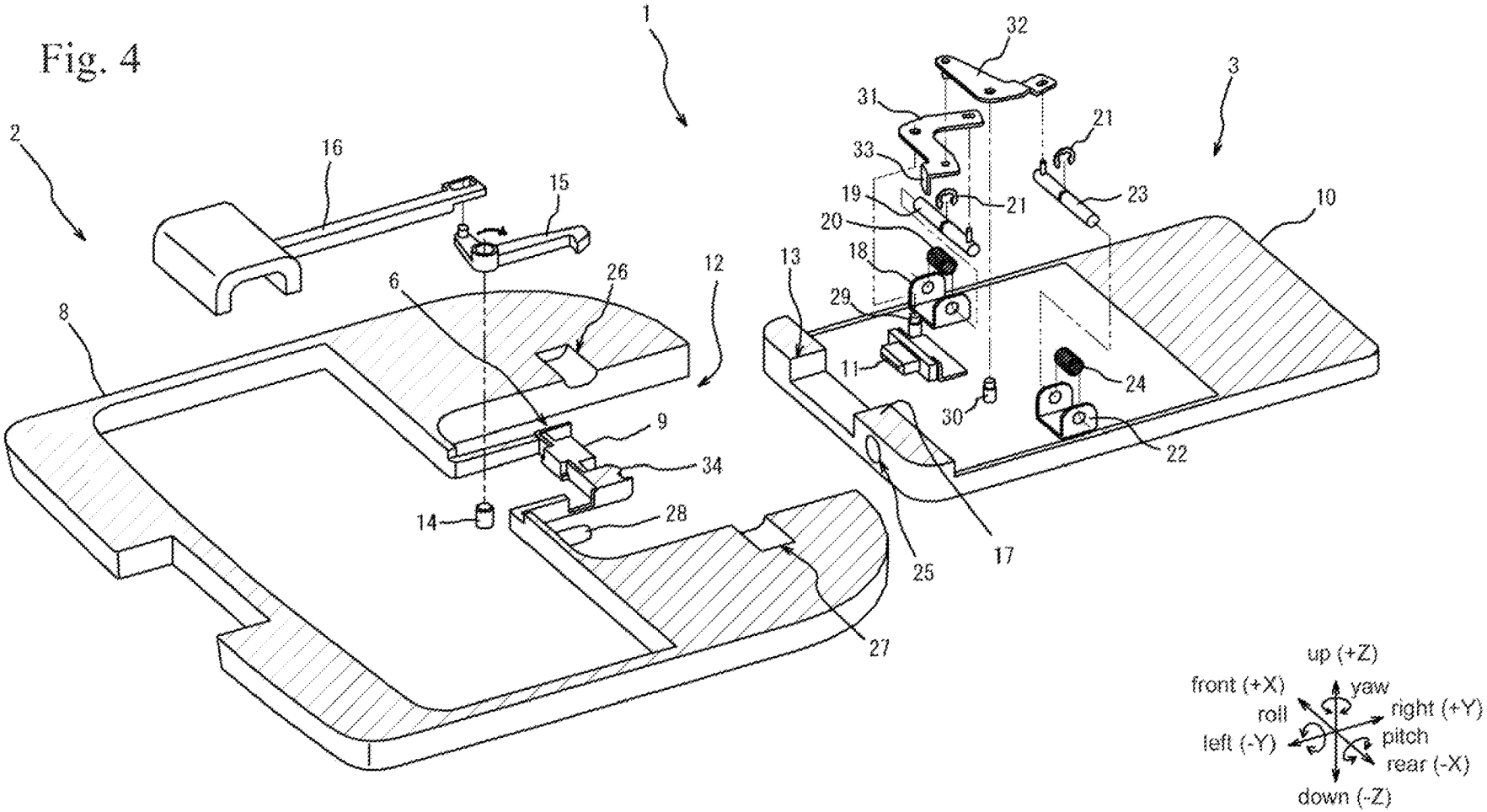
FIG. 4 is an exploded view of the embroidery unit attaching and detaching device shown in FIG. 1.

Then, the embroidery unit attaching and detaching device 1 will be explained in detail with reference to FIG. 3 and FIG. 4. Note that FIG. 3 is a partial cross sectional view cutting the embroidery unit 2 and the sewing machine 3 by an XY plane for showing the inside of the embroidery unit attaching and detaching device 1. The position (height) of the XY plane cutting the components is basically the height shown by the line A in FIG. 2 but the position (height) is arbitrarily changed for the convenience of the explanation. FIG. 4 is an exploded view based on FIG. 3.

The embroidery unit attaching and detaching device 1 of the present embodiment includes the above described connector unit 6. In the present embodiment, the connector unit 6 is formed by a female connector 9 provided on a bottom portion 8 of the embroidery unit and a male connector 11 provided on a bottom portion 10 of the sewing machine. Note that the female connector 9 is electrically connected with the above described not-illustrated motor for moving the carriage 5, and the male connector 11 is electrically connected with a controller of the sewing machine 3. As illustrated, a recessed portion 12 is provided on the bottom portion 8 of the embroidery unit so that the bottom portion 10 of the sewing machine is housed in the recessed portion 12, and an opening portion 13 is provided on a left end portion of the bottom portion 10 of the sewing machine. When the embroidery unit 2 is moved in the attaching direction, the bottom portion 10 of the sewing machine is housed inside the recessed portion 12 and the female connector 9 is inserted through the opening portion 13 and electrically connected with the male connector 11.

As shown in FIG. 4, the embroidery unit attaching and detaching device 1 includes a locking claw rotating shaft 14 having a cylindrical (columnar) shape protruded upward and provided on the bottom portion 8 of the embroidery unit. A locking claw 15 is attached to the locking claw rotating shaft 14 so as to be rotatable. The locking claw 15 of the present embodiment has a circular hole inserted around the locking claw rotating shaft 14. In addition, the locking claw 15 has a claw-shaped portion protruded from the front to the rear at one end and a protrusion protruded upward at the other end. Note that the locking claw 15 is energized by a not-illustrated spring in a clockwise direction (direction of the arrow shown in FIG. 3) in a plan view. In addition, as shown in FIG. 3, the locking claw 15 of the present embodiment is provided in a state of being incorporated in the connector unit 6 at the left part of the female connector 9.

Furthermore, the embroidery unit attaching and detaching device 1 includes a lock releasing lever 16 so that one end of the lock releasing lever 16 is engaged with the protrusion of the locking claw 15. The lock releasing lever 16 can be moved in the left/right direction with respect to the embroidery unit 2. In the present embodiment, when the lock releasing lever 16 is moved from the right to the left, the locking claw 15 is rotated in a counterclockwise direction in a plan view in association with the motion of the lock releasing lever 16. Furthermore, the embroidery unit attaching and detaching device 1 includes a lock receiving portion 17. The lock receiving portion 17 of the present embodiment is provided on the bottom portion 10 of the sewing machine of the sewing machine 3. When the locking claw 15 is rotated in the clockwise direction in a plan view, the lock receiving portion 17 is engaged with the locking claw 15.

Note that the locking claw rotating shaft 14, the locking claw 15, the lock releasing lever 16 and the lock receiving portion 17 which are described above correspond to "lock mechanism" of the specification of the present invention. In addition, the locking claw 15 corresponds to "embroidery unit side lock portion" of the specification of the present invention and the lock receiving portion 17 corresponds to "sewing machine side lock portion" of the specification of the present invention.

Furthermore, the embroidery unit attaching and detaching device 1 includes a first link base 18 provided on the front part of the bottom portion 10 of the sewing machine. The first link base 18 of the present embodiment has a U-shape in a view viewed along the Y-axis direction. Through holes having a circular shape are formed on the front part and the rear part of the first link base 18. In addition, the embroidery unit attaching and detaching device 1 includes: a first support pin 19 having a cylindrical (columnar) shape inserted into the through holes of the first link base 18 so as to be movable in the front/rear direction; a first compression spring 20 having a coil shape; and an E-ring 21 attached to the first support pin 19 for preventing the first support pin 19 and the first compression spring 20 from coming off from the first link base 18. The first support pin 19 of the present embodiment is energized from the front to the rear by the first compression spring 20 when the first support pin 19 is attached to the first link base 18. In the energized state, the tip end portion of the first support pin 19 is located at the position aligned with the front end of the bottom portion 10 of the sewing machine or located at the position rearward than the front end of the bottom portion 10 of the sewing machine. Namely, the first support pin 19 is energized by the first compression spring 20 and housed inside of the bottom portion 10 of the sewing machine.

The embroidery unit attaching and detaching device 1 includes a second link base 22, a second support pin 23 and a second compression spring 24 which have the same shape as the first link base 18, the first support pin 19 and the first compression spring 20 respectively. As illustrated, the second link base 22 is provided on the rear part of the bottom portion 10 of the sewing machine and the second support pin 23 is supported by the second link base 22 so as to be movable in the front/rear direction. In the present embodiment, the center axis of the second support pin 23 supported by the second link base 22 is located on the center axis of the first support pin 19 supported by the first link base 18. In addition, the second support pin 23 is energized from the rear to the front by the second compression spring 24 in a state that the second support pin 23 is attached to the second link base 22 by the E-ring 21. In the energized state, the tip end portion of the second support pin 23 is located at the position aligned with the rear end of the bottom portion 10 of the sewing machine or located at the position frontward than the rear end of the bottom portion 10 of the sewing machine. Namely, the second support pin 23 is energized by the second compression spring 24 and housed inside of the bottom portion 10 of the sewing machine.

Note that the above described mechanism of housing the first support pin 19 and the second support pin 23 including the first compression spring 20 and the second compression spring 24 inside the bottom portion 10 of the sewing machine corresponds to "protruded portion projecting mechanism" of the specification of the present invention.

In addition, the embroidery unit attaching and detaching device 1 includes a circular hole (third support hole 25) provided on the left side surface of the bottom portion 10 of the sewing machine. Note that the position (height) of the center axis of the third support hole 25 in the vertical direction is same as the height of the center axes of the first support pin 19 and the second support pin 23 (i.e., the height of the line A shown in FIG. 2A).

As for the mechanism engaged with the first support pin 19, the second support pin 23 and the third support hole 25 described above, the embroidery unit attaching and detaching device 1 of the present embodiment includes a first support hole 26, a second support hole 27 and a third support pin 28 provided on the bottom portion 8 of the embroidery unit. As shown in FIG. 3, the first support hole 26 is provided on the front end of the recessed portion 12 in the bottom portion 8 of the embroidery unit and the second support hole 27 is provided on the rear end of the recessed portion 12. Note that the length of the hollow space of the first support hole 26 and the second support hole 27 in the up/down direction is approximately same as the outer diameter of the first support pin 19 and the second support pin 23 while the length of the hollow space in the left/right direction is larger than the outer diameter of the first support pin 19 and the second support pin 23. Thus, the hollow space has a long hole shape (track shape).

In addition, the third support pin 28 has a cylindrical (columnar) shape protruded rightward from the left end of the recessed portion 12. Note that the outer diameter of the third support pin 28 is approximately same as the inner diameter of the third support hole 25. In addition, the tip end portion of the third support pin 28 is formed in a tapered shape.

Although the details will be described later, when the embroidery unit 2 is moved in the attaching direction (moved from the left to the right) with respect to the sewing machine 3, the first support pin 19 is inserted into the first support hole 26, the second support pin 23 is inserted into the second support hole 27 and the third support pin 28 is inserted into the third support hole 25. Namely, the embroidery unit 2 attached to the sewing machine 3 is restricted (prevented) from relatively moving in the up/down direction with respect to the sewing machine 3 (not moved in the up/down direction almost at all) by the above described three pins and three support holes. In addition, the embroidery unit 2 is restricted from relatively moving in the front/rear direction with respect to the sewing machine 3 by the third support pin 28 and the third support hole 25. Furthermore, the engaged position of the third support pin 28 inserted into the third support hole 25 and engaged with the third support hole 25 is displaced to the left with respect to the engaged position of the first support pin 19 engaged with the first support hole 26 and the engaged position of the second support pin 23 engaged with the second support hole 27. In other words, the engaged position of the third support pin 28 is displaced from the straight line connecting the engaged position of the first support pin 19 and the engaged position of the second support pin 23. Namely, the above described three engaged positions arranged to form a single plane without being arranged on a straight line.

Note that the first support pin 19, the first support hole 26, the second support pin 23, the second support hole 27, the third support pin 28 and the third support hole 25 correspond to "support mechanism" of the specification of the present invention. In addition, the first support pin 19, the second support pin 23 and the third support pin 28 correspond to "protruded portion" of the specification of the present invention and the first support hole 26 and the second support hole 27 and the third support hole 25 correspond to "recessed portion" of the specification of the present invention.

As shown in FIG. 4, the embroidery unit attaching and detaching device 1 includes a first link rotation shaft 29 and a second link rotation shaft 30 having a cylindrical (columnar) shape protruded upward from the bottom portion 10 of the sewing machine. A first link 31 is attached to the first link rotation shaft 29 so as to be rotatable and a second link 32 is attached to the second link rotation shaft 30 so as to be rotatable. As illustrated, the first link 31 of the present embodiment has a plate shape. The first link 31 has a circular hole inserted around the first link rotation shaft 29. A hole into which a protrusion protruded from the first support pin 19 is inserted is formed on one end portion of the first link 31 and a hole engaged with the second link 32 is formed on the other end portion of the first link 31. In addition, a receiving member 33 folded downward is formed on the other end portion of the first link 31. As shown in FIG. 3, the receiving member 33 is located on the rear part of the male connector 11 and adjacent to the male connector 11 in a state that the first link 31 is attached to the second link rotation shaft 30. As illustrated, the second link 32 of the present embodiment has a plate shape. The second link 32 has a circular hole inserted around the second link rotation shaft 30. A hole into which a protrusion protruded from the second support pin 23 is inserted is formed on one end portion of the second link 32 and a protrusion inserted into the hole formed on the other end portion of the first link 31 and engaged with the first link 31 is formed on the other end portion of the second link 32.

As for the member cooperated with the receiving member 33, the embroidery unit attaching and detaching device 1 of the present embodiment includes a pressing portion 34 provided on the bottom portion 8 of the embroidery unit. The pressing portion 34 is located on the rear part of the female connector 9 and adjacent to the female connector 9.

Then, the attaching and detaching operations of the embroidery unit 2 to/from the sewing machine 3 using the above described embroidery unit attaching and detaching device 1 will be explained with reference to FIG. 2 to FIG. 5C.

First, in a state that the embroidery unit 2 is detached from the sewing machine 3, as shown in FIG. 3, the first support pin 19 and the second support pin 23 are energized by the first compression spring 20 and the second compression spring 24 and housed inside the bottom portion 10 of the sewing machine.

Figure 5A:
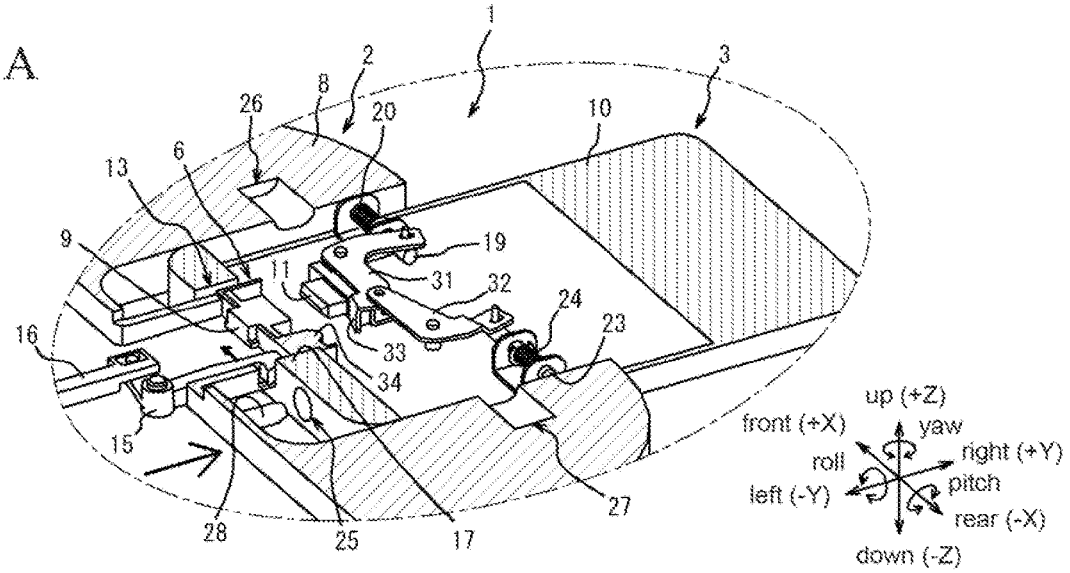
FIGS. 5A to 5C are explanatory drawings regarding attachment/detachment motions of the attaching and detaching device and the sewing machine shown in FIG. 1.

When the user moves the embroidery unit 2 in the attaching direction (moves from the left to the right) at the position where the bottom portion 10 of the sewing machine enters in the recessed portion 12, as shown in FIG. 5A, the female connector 9 is inserted in the opening portion 13 and the locking claw 15 pressed against the lock receiving portion 17 is rotated in the counterclockwise direction in a plan view while resisting the energizing force of the not-illustrated spring.

When the user further moves the embroidery unit 2 in the attaching direction, the third support pin 28 is inserted into the third support hole 25. As described above, the tip end portion of the third support pin 28 has a tapered shape. Thus, even when the embroidery unit 2 is slightly inclined in the Y-axis direction when the embroidery unit 2 is moved, the tip end portion of the third support pin 28 can be inserted into the third support hole 25. Namely, the tip end portion of the third support pin 28 functions as a positioning guide when the embroidery unit 2 is moved in the attaching direction with respect to the sewing machine 3.

Figure 5B:
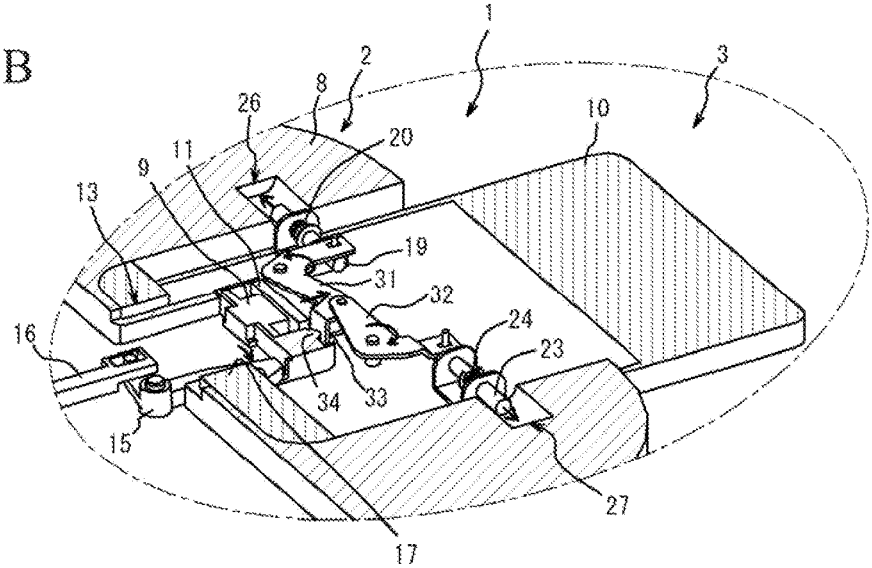
Figure 5C:
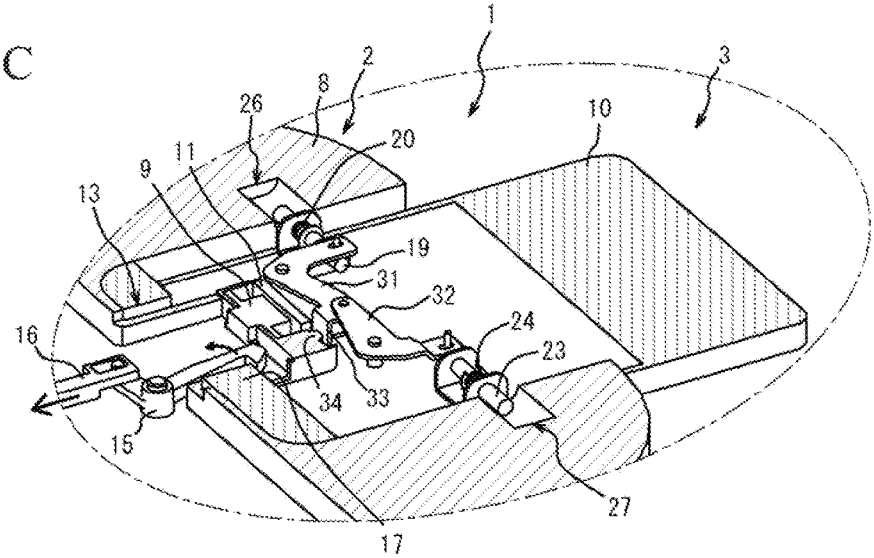

When the embroidery unit 2 is further moved in the attaching direction until the third support pin 28 is completely inserted into the third support hole 25, the locking claw 15 energized by a not-illustrated spring is rotated in the clockwise direction in a plan view, as shown in FIG. 5B. Thus, the locking claw 15 is engaged with the lock receiving portion 17. In the above described state, the male connector 11 is inserted into the female connector 9 and the male connector 11 and the female connector 9 are electrically connected with each other. Furthermore, in the above described state, the pressing portion 34 is pressed against the receiving member 33. Because of this, the first link 31 and the second link 32 are rotated and the first support pin 19 and the second support pin 23 are projected outward from the bottom portion 10 of the sewing machine. Since the first support hole 26 and the second support hole 27 are formed in a long hole shape where the length of the hollow space in the left/right direction is longer the length of the hollow space in the up/down direction, even when the first support pin 19 and the second support pin 23 are gradually projected when the embroidery unit 2 is moved in the attaching direction, the first support pin 19 and the second support pin 23 are smoothly inserted into the first support hole 26 and the second support hole 27. In addition, since the first support hole 26 and the second support hole 27 are formed in a long hole shape, even when the positons of the first link base 18 and the second link base 22 supporting the first support pin 19 and the second support pin 23 are slightly displaced in the left/right direction with respect to the bottom portion 10 of the sewing machine, the first support pin 19 and the second support pin 23 are surely inserted into the first support hole 26 and the second support hole 27.

As described above, when the embroidery unit 2 is completely moved in the attaching direction, as shown in FIG. 5B, the locking claw 15 is engaged with the lock receiving portion 17. Thus, the embroidery unit 2 is restricted from relatively moving to the left with respect to the sewing machine 3. In the above described state, the first support pin 19 is engaged with the first support hole 26, the second support pin 23 is engaged with the second support hole 27 and the third support pin 28 is engaged with the third support hole 25. Namely, as described above, the embroidery unit 2 is restricted from relatively moving in the up/down direction and front/rear direction with respect to the sewing machine 3. Accordingly, even when only the sewing machine 3 is lifted up in the above described state, the embroidery unit 2 can be prevented from falling from the sewing machine 3. In addition, since the engaged positions of engaging three pins with three holes are arranged to form a single plane as described above, the embroidery unit 2 is firmly fixed in the roll direction, the pitch direction and the yaw direction. Accordingly, even when only the sewing machine 3 is lifted up in the above described state, the moment load is not excessively applied on the female connector 9 and the male connector 11. Thus, the damage of the female connector 9 and the male connector 11 can be prevented.

When detaching the embroidery unit 2 attached to the sewing machine 3, the lock releasing lever 16 shown in FIG. 3 is pulled leftward. Consequently, the locking claw 15 connected to the lock releasing lever 16 is rotated in the counterclockwise direction in a plan view and the engagement between the locking claw 15 and the lock receiving portion 17 is released. Thus, the embroidery unit 2 can be moved to the left with respect to the sewing machine 3. When the user pulls the lock releasing lever 16 to the left, the embroidery unit 2 is also pulled to the left via the lock releasing lever 16. Thus, the embroidery unit 2 is moved to the left simultaneously with the disengagement of the locking claw 15 and the lock receiving portion 17. Consequently, the third support pin 28 is extracted from the third support hole 25. In addition, since the embroidery unit 2 is moved to the left, the pressing portion 34 is separated from the receiving member 33. As a result, the first link 31 and the second link 32 are rotated, the first support pin 19 is extracted from the first support hole 26 and the second support pin 23 is extracted from the second support hole 27. Accordingly, the embroidery unit 2 can be detached from the sewing machine 3.

An embodiment realizing the present invention is illustrated above. However, the present invention is not limited to the above described specific embodiment. Unless particularly limited in the above described explanation, various modification and change are possible in the range of the scope of the present invention described in the claims. In addition, the above described effects of the embodiment merely exemplify the effects arisen from the present invention. The effects of the present invention are not limited to the above described effects.

For example, in the above described embodiment, the first support pin 19, the second support pin 23 and the third support hole 25 are provided on the sewing machine 3 while the first support hole 26, the second support hole 27 and the third support pin 28 are provided on the embroidery unit 2. However, the arrangement of the pins and support holes can be reversed. The number of the pins and support holes can be four or more. When the first support pin 19 and the second support pin 23 are provided on the embroidery unit 2, the above described protruded portion projecting mechanism can be provided on the embroidery unit 2. In addition, the support mechanism is not limited to the above described pin shape. The support mechanism can be formed by the member such as a block and a plate.

Although the heights of the center axis of the first support pin 19, the second support pin 23 and the third support pin 28 are same (height of the line A) in the above described embodiment, the heights can be made different.

Although the locking claw 15 is incorporated in the connector unit 6 in the above described embodiment, the locking claw 15 can be separately provided near the connector unit 6 or inside the third support pin 28. It is also possible that the locking claw 15 is provided on the sewing machine 3 and the lock receiving portion 17 is provided on the embroidery unit 2. In the above described case, it is possible that the lock receiving portion 17 is separated from the locking claw 15 by operating the lock releasing lever 16 and thus the engagement between the locking claw 15 and the lock receiving portion 17 is released.

Although it is effective to form the first support hole 26 and the second support hole 27 in a long hole shape when the first support pin 19 and the second support pin 23 are gradually projected as described above, it is also possible to form the first support hole 26 and the second support hole 27 in a circular shape by appropriately adjusting the timing of projecting the first support pin 19 and the second support pin 23.

In addition, the first support hole 26 and the second support hole 27 can be a groove formed by notching the embroidery unit 2 in the left/right direction. When the first support hole 26 and the second support hole 27 are formed as the groove, the first support pin 19 and the second support pin 23 can be formed to permanently project outward from the bottom portion 10 of the sewing machine. Namely, the above described protruded portion projecting mechanism can be omitted.

In addition, the direction of attaching and detaching the embroidery unit 2 to/from the sewing machine 3 is not limited to the left/right direction. It can be the front/rear direction.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. An embroidery unit attaching and detaching device enabling to detachably attach an embroidery unit to a sewing machine, comprising:

a lock mechanism configured to operate in association with a motion of the embroidery unit in an attaching direction to restrict the motion of the embroidery unit in a detaching direction with respect to the sewing machine;

a first recessed portion provided on one of the sewing machine and the embroidery unit; and a first protruded portion provided on the other of the sewing machine and the embroidery unit;

a second recessed portion provided on one of the sewing machine and the embroidery unit;

a second protruded portion provided on the other of the sewing machine and the embroidery unit;

a third recessed portion provided on one of the sewing machine and the embroidery unit; and a third protruded portion provided on the other of the sewing machine and the embroidery unit, wherein the first recessed portion and the first protruded portion are configured to engage with each other, the second recessed portion and the second protruded portion are configured to engage with each other and the third recessed portion and the third protruded portion are configured to engage with each other to form a support mechanism for restricting a relative motion of the sewing machine and the embroidery unit in a vertical direction, the first protruded portion and the second protruded portion are protruded in a front/rear direction of the sewing machine and movable in the front/rear direction, and the third protruded portion is protruded in a left/right direction of the sewing machine.

2. The embroidery unit attaching and detaching device according to claim 1, further comprising:

a protruded portion projecting mechanism configured to house the first protruded portion and the second protruded portion inside the protruded portion projecting mechanism, wherein the first protruded portion and the second protruded portion are configured to project toward the first recessed portion and the second recessed portion respectively when the embroidery unit is moved in the attaching direction.

3. The embroidery unit attaching and detaching device according to claim 1, wherein the lock mechanism includes:

a lock releasing lever configured to move in the detaching direction with respect to the embroidery unit;

a sewing machine side lock portion provided on the sewing machine; and an embroidery unit side lock portion provided on the embroidery unit, wherein the embroidery unit side lock portion is configured to engage with the sewing machine side lock portion and operate in association with a motion of the lock releasing lever in the detaching direction to release an engagement from the sewing machine side lock portion.

4. A sewing machine comprising:

the embroidery unit attaching and detaching device of claim 1; and the embroidery unit.

5. The embroidery unit attaching and detaching device according to claim 1, further comprising:

a first link attached to one of the sewing machine and the embroidery unit so as to be rotatable, and a second link attached to one of the sewing machine and the embroidery unit so as to be rotatable, wherein when the embroidery unit is pressed against the sewing machine, the first link and the second link are rotated to press the first protruded portion and the second protruded portion respectively in the front/rear direction.

* * * * *